United States Patent [19]

Spaccapaniccia

[11] 4,259,972

[45] Apr. 7, 1981

[54] SUPPORT FOR DRYING HAIR

[76] Inventor: Domenico Spaccapaniccia, Via XX Giugno, 16 Fermo, Italy

[21] Appl. No.: 35,320

[22] Filed: Jul. 20, 1979

[30] Foreign Application Priority Data

May 16, 1978 [IT] Italy ..... 17906 A/78

[51] Int. Cl.[3] ..... A45D 20/00

[52] U.S. Cl. ..... 132/9

[58] Field of Search ..... 132/9, 40, 53, 54, 42

[56] References Cited

U.S. PATENT DOCUMENTS

| | | | |
|---|---|---|---|
| 2,173,872 | 9/1939 | Barnes | 132/40 |
| 2,595,844 | 5/1952 | Graham | 132/40 X |
| 3,126,018 | 3/1964 | Sidelman | 132/54 |
| 3,747,610 | 7/1973 | Serrat | 132/9 |

*Primary Examiner*—G. E. McNeill

*Attorney, Agent, or Firm*—Blair, Brown & Kreten

[57] ABSTRACT

Disclosed herein is an element of truncated conical configuration having a plurality of openings thereon in which hair is allowed to pass through the inner portion of the cone and drape along the outer sides thereof. The holes provided on the cone allow the hair to be dried under a hair dryer much more quickly than the prior art.

2 Claims, 2 Drawing Figures

SUPPORT FOR DRYING HAIR

BACKGROUND & SUMMARY OF THE INVENTION

The object of the invention is to provide an element in plastic material, which has the form of the trunk of a slightly oblique cone, with the help of which it is possible to notably reduce the drying time for hair underneath the hairdrier hood and also with particularly interesting and advantageous results in the case for drying very long hair that similarly needs long and laborious drying with a hairdrier.

DESCRIPTION OF THE PREFERRED EMBODIMENT

Figure 1:
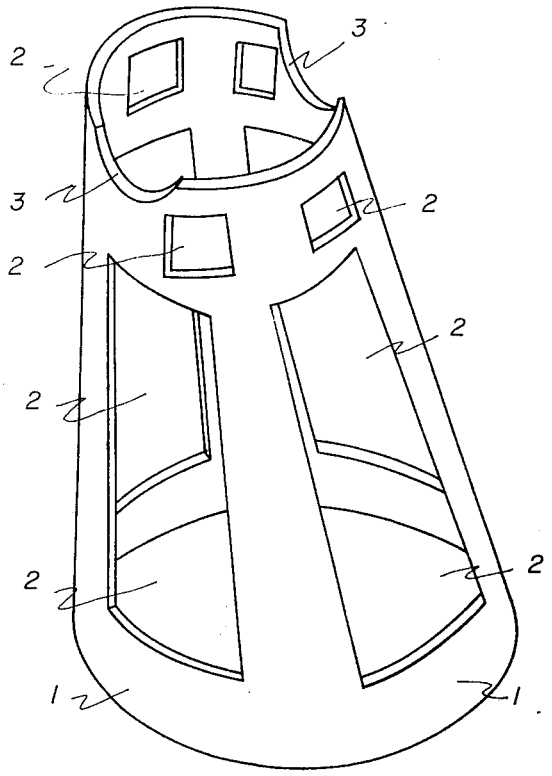
FIG. 1 is a perspective view of the apparatus according to the present invention.
Figure 2:
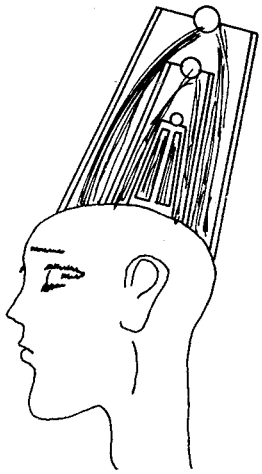
FIG. 2 shows plural apparatus disposed on the head of a person.

With reference to the FIG. 1 here enclosed the truncated cone element 1 has along its side surface numerous ventilation cutouts 2 which are more or less large and rectangular, and which ensure a continuous and uniform flow of hot air over the hair held tight and fixed on the inside of each element 1.

As is clearly shown in the description originally presented, indeed, in working practice, the element in question is not only used by itself, but in combination with a series of similar elements, of dimensions respectively larger by putting one on top of the other successively.

Along the upper edge of each element in the series there are two semi-circular cutouts 3 adapted to hold the roller which, after it has just been rolled into the end of the bunch of hair, is fixed by the aid of hair clips, hair pins or the like.

Naturally the rollers that are used will also be of gradually increasing dimensions matching the elements and with larger diameters.

After having fixed the first element 1 then, in the center of the area being worked on, the elements are put concentrically and successively on the outside of the previous one, and on each the bunch of hair from the round crown of the scalp is fixed between the perimeter of the base of the element and that of the immediately preceding element.

Having thus described the preferred embodiment of the invention it should be understood that numerous structural modifications and adaptations may be resorted to without departing from the spirit of the invention.

What is claimed is:

1. A truncated cone element for gripping hair in position tightly, in order to notably reduce the drying time under a hairdrier hood, and characterized by an element of plastic material, in the form of a truncated cone having parallel, slightly oblique upper and lower edges, said cone having around its side surfaces a series of ventilation cutouts more or less large and of rectangular shape, which ensure a continuous and uniform flow of hot air over the hair gripped on the inside of said element, and along said upper edge of said cone, are two semicircular cutouts diametrically opposed, and adapted to receive a roller, which after a minimal wrapping at the end of a hair bunch, the roller is fixed in place by means of hair pins, clips or the like so that the hair thus treated has a substantially uncurled portion proximate to the scalp area and curled hair termini.

2. The device of claim 1 wherein plural elements are provided of successively larger dimension and oriented in a concentric array on the head of a person being treated whereby successive, outwardly eminating areas of hair can be treated.

* * * * *